US009614286B2

(12) United States Patent
Du et al.

(10) Patent No.: US 9,614,286 B2
(45) Date of Patent: Apr. 4, 2017

(54) DUAL-BAND DIPOLE ANTENNA

(71) Applicant: ARCADYAN TECHNOLOGY CORPORATION, Hsinchu (TW)

(72) Inventors: Jian-Jhih Du, Taipei (TW); Chih-Yung Huang, Taichung County (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 49 days.

(21) Appl. No.: 14/694,439

(22) Filed: Apr. 23, 2015

(65) Prior Publication Data

US 2016/0233586 A1 Aug. 11, 2016

(30) Foreign Application Priority Data

Feb. 6, 2015 (TW) ..... 104104118 A

(51) Int. Cl.

| | |
|---|---|
| ***H01Q 9/16*** | (2006.01) |
| ***H01Q 1/24*** | (2006.01) |
| ***H01Q 1/38*** | (2006.01) |
| ***H01Q 9/38*** | (2006.01) |
| ***H01Q 9/42*** | (2006.01) |
| ***H01Q 5/371*** | (2015.01) |

(52) U.S. Cl.

CPC ..... *H01Q 9/16* (2013.01); *H01Q 1/241* (2013.01); *H01Q 1/38* (2013.01); *H01Q 5/371* (2015.01); *H01Q 9/38* (2013.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 7,692,599 | B2 * | 4/2010 | Wong | H01Q 9/285 343/700 MS |
| 2009/0115679 | A1 * | 5/2009 | Chou | H01Q 1/38 343/795 |
| 2009/0184876 | A1 * | 7/2009 | Liu | H01Q 1/38 343/700 MS |
| 2012/0001818 | A1 * | 1/2012 | Lee | H01Q 1/38 343/817 |
| 2013/0321231 | A1 * | 12/2013 | Flores-Cuadras | H01Q 9/285 343/793 |
| 2015/0162664 | A1 * | 6/2015 | Kawata | H01Q 9/285 343/749 |

* cited by examiner

*Primary Examiner* — Trinh Dinh

(74) *Attorney, Agent, or Firm* — WPAT, PC; Justin King

(57) ABSTRACT

A dual-band dipole antenna includes a substrate, grounding area, main radiator, grounding point and a feed-in point. The grounding point may be disposed on the substrate. The main radiator may be disposed on the substrate and in the vicinity of the grounding point; the main radiator may comprises a first radiator and a second radiator, wherein the first radiator may be connected to the second radiator, and there may be a groove between the first radiator and the second radiator; besides the size of the main radiator is disproportional to the size of the grounding area. The grounding point may be disposed on the substrate and connected to the grounding area. The feed-in point may be disposed on the substrate and connected to the main radiator; the grounding point may be in the vicinity of the feed-in point.

14 Claims, 10 Drawing Sheets

DUAL-BAND DIPOLE ANTENNA

BACKGROUND OF THE INVENTION

1. Field of the Invention

The present invention generally relates to a dual-band dipole antenna, in particular to a dual-bank dipole printed antenna with simple structure, low cost and flexible operating frequency band.

2. Description of the Related Art

With the advance of the technology, mobile electronic devices have become indispensable products for most people. As mobile electronic devices become more and more compact than before, various antennas with different sizes and functions are developed in order to conform to the requirements of various mobile electronic devices (e.g. mobile phone, notebook, etc.) and wireless transmission devices (e.g. wireless access point, wireless network card, etc.). Several kinds of antennas have been comprehensively applied to mobile electronic devices, such as the planar inverse-F antenna (PIFA), the monopole antenna or the dipole antenna because these antennas have compact size, good transmission performance and can be easily installed on the inner wall of a mobile electronic device.

However, the conventional antennas still have a lot of shortcomings to be overcome. For example, as the bandwidth of most conventional antennas is narrow, the structure of the antenna will be very complicated if the antenna is applied to a wide-band system; besides, it is very hard to adjust the bandwidth of the conventional antennas according to different requirements; thus, the application of the conventional antennas is greatly limited. Moreover, the conventional antennas should be manufactured by molds and need additional assembly process, which will significantly increase the cost of the conventional antennas.

Therefore, it has been an important issue to provide an antenna with simple structure, low cost, simpler manufacturing process and easily-adjustable operating frequency band.

SUMMARY OF THE INVENTION

Therefore, it is a primary objective of the present invention to provide a dual-band dipole antenna with simple structure, low cost, simpler manufacturing process and easily-adjustable operating frequency band.

To achieve the foregoing objective, the present invention provides a dual-band dipole antenna. The antenna may include a substrate, a grounding area, a main radiator, a grounding point and a feed-in point. The grounding point may be disposed on the substrate. The main radiator may be disposed on the substrate and in the vicinity of the grounding point; the main radiator may comprises a first radiator and a second radiator, wherein the first radiator may be connected to the second radiator, and there may be a groove between the first radiator and the second radiator; besides the size of the main radiator is disproportional to the size of the grounding area. The grounding point may be disposed on the substrate and connected to the grounding area. The feed-in point may be disposed on the substrate and connected to the main radiator; the grounding point may be in the vicinity of the feed-in point, and the groove may be formed at a closed structure in the vicinity of the feed-in point and extend in the direction away from the feed-in point to form an opening structure.

In a preferred embodiment, the grounding area may be L-shaped and include a patch block.

In a preferred embodiment, the grounding area may include two ends corresponding to each other in the first direction; one end may be in the vicinity of the main radiator and disposed with the grounding point, and the other end may be disposed with the patch block and the patch block may extend in the second direction to make the grounding area be L-shaped.

In a preferred embodiment, the size of the grounding area may be larger than the size of the main radiator.

In a preferred embodiment, the size of the grounding area may be related to an impedance matching of the dual-band antenna.

In a preferred embodiment, the groove may extend in the third direction away from the feed-in point to form the opening structure.

In a preferred embodiment, the included angle between the third direction and the first direction may be an obtuse angle.

In a preferred embodiment, the first radiator may extend from the feed-in point to the third direction to form a gradually-widened structure, and the second radiator may extend from the feed-in point to the third direction to from a gradually-narrowed structure.

In a preferred embodiment, the operating frequency band of the second radiator may be higher than the operating frequency band of the first radiator.

In a preferred embodiment, the length of the first radiator may be related to the low operating frequency band of the dual-band dipole antenna.

In a preferred embodiment, the length of the second radiator may be related to the high operating frequency band of the dual-band dipole antenna.

In a preferred embodiment, the grounding point and the feed-in point may be disposed between the main radiator and the grounding area.

In a preferred embodiment, the groove may extend from the corner of the main radiator into the interior of the main radiator.

In a preferred embodiment, the groove may be connected to a slot inside the main radiator.

In a preferred embodiment, the size of the slot may be related to the overall operating frequency band of the dual-band dipole antenna.

The dual-band dipole antenna according to the present invention has the following advantages:

(1) In one embodiment of the present invention, the overall operating frequency of the dual-band dipole antenna can be adjusted by adding one or more patch blocks to the main radiator to increase the size of the main radiator, such that the antenna can conform to various requirements and the application of the antenna can be more comprehensive.

(2) In one embodiment of the present invention, the low operating frequency band and the high operating frequency band can be respectively fine-tuned by adjusting the lengths of the first radiator and the second radiator, so the application of the antenna can be more comprehensive and be able to meet different requirements.

(3) In one embodiment of the present invention, the design of the present invention can be implemented by a printed antenna, so the antenna can be manufacturing without using molds and without assembly process; accordingly, the cost of the antenna can be significantly reduced to increase its product competitiveness.

(4) The antenna according to the present invention can still have good impedance matching even if the antenna is very close to the ground, so the antenna can achieve better performance.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

The technical content of the present invention will become apparent by the detailed description of the following embodiments and the illustration of related drawings as follows.

Figure 1:
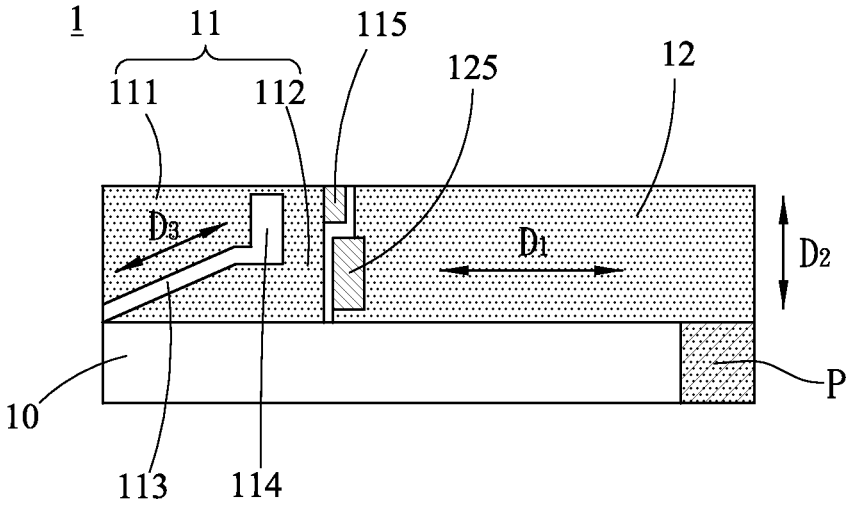
FIG. 1 is the first schematic view of the first embodiment in accordance with the present invention.

Please refer to FIG. 1, which is the first schematic view of the first embodiment of the dual-bank dipole antenna in accordance with the present invention. The embodiment implements the concept of the present invention by a printed antenna. As shown in FIG. 1, the dual-band dipole antenna 1 of the embodiment may include a substrate 10, a grounding area, a main radiator 11, a grounding point 125 and a feed-in point 115.

The main radiator 11 is disposed on the substrate 10 and in the vicinity of the grounding area 12; the main radiator 11 may include a first radiator 111 and a second radiator 112, where the first radiator 111 and the second radiator 112 may be connected to each other and there may be a groove 113 between them; the operating frequency band of the first radiator 111 may be higher than the operating frequency band of the second radiator 112. In the embodiment, the main radiator 11 is rectangular in shape and the groove 113 extends from the lower left corner of the main radiator 11 into its interior; the two sides of the main radiator 11 respectively have an included angle with the groove 113. In the embodiment, there is a slot 114 inside the main radiator 11, where the slot 114 may be rectangular in shape and connected to the groove 113. The feed-in point is disposed on the substrate 10 and connected to the main radiator 11; besides, the grounding point 125 is disposed in the vicinity of the feed-in point 115.

In the embodiment, the groove 113 between the first radiator 111 and the second radiator 112 may be a closed structure formed in the vicinity of the feed-in point 115; besides, the groove 113 may further extend in the third direction D3 away from the feed-in point 115 to form an opening structure. As shown in FIG. 1, the included angle between the third direction D3 and the first direction D1 is an obtuse angle; the first radiator 111 extends from the feed-in point 115 to the third direction D3 to form a gradually-widened structure, and the second radiator 112 extends from the feed-in point 115 to the third direction D3 to from a gradually-narrowed structure.

The grounding area 12 is disposed on the substrate 10. In the embodiment, the grounding area 12 includes two ends corresponding to each other in the first direction D1; one end is in the vicinity of the main radiator 11 and disposed with the grounding point 125, and the other end is disposed with the patch block P and the patch block P extends in the second direction D2 to make the grounding area 12 be L-shaped. The size of the grounding area 12 may be larger than the size of the main radiator 11; as shown in FIG. 1, the size and shape of the grounding area 12 is unsymmetrical to the size and shape of the main radiator 11. The size of the grounding area 12 is related to the impedance matching of the dual-band dipole antenna 1; for instance, the impedance matching of the dual-bank dipole antenna 1 can be adjusted by changing the width of the grounding area 12. The grounding point 125 is disposed on the substrate 10 and connected to the grounding area 12. The feed-in point 115 and the grounding point 125 can be disposed at the space between the main radiator 11 and the grounding area 12.

The operating frequency band of the dual-bank antenna 1 can be adjusted by using special patch blocks or changing the lengths of the first radiator 111 and the second radiator 112. For instance, the length of the first radiator 111 can be changed to adjust the low operating frequency band of the dual-band dipole antenna 1; for instance, the length of the second radiator 112 can be changed to adjust the high operating frequency band of the dual-band dipole antenna 1; for instance, the overall operating frequency band of the dual-bank dipole antenna 1 can be adjusted by adding patch blocks to the slot 114 of the main radiator 11. Besides, by means of the above special design, the dual-band dipole antenna 1 can still have good impedance even if it is very close to the ground; thus, the dual-band dipole antenna 1 can exactly achieve better performance.

As described above, when a designer want to design the dual-band dipole antenna 1 of the embodiment for a specific purpose, the antenna designer can not only adjust the overall operating frequency band of the antenna 1, but also can independently adjust its low operating frequency band or high operating frequency band; accordingly, the dual-band dipole antenna 1 can be easily designed to satisfy the requirements of various applications, which is more flexible in usage and very suitable for various dual-band products.

Figure 2:
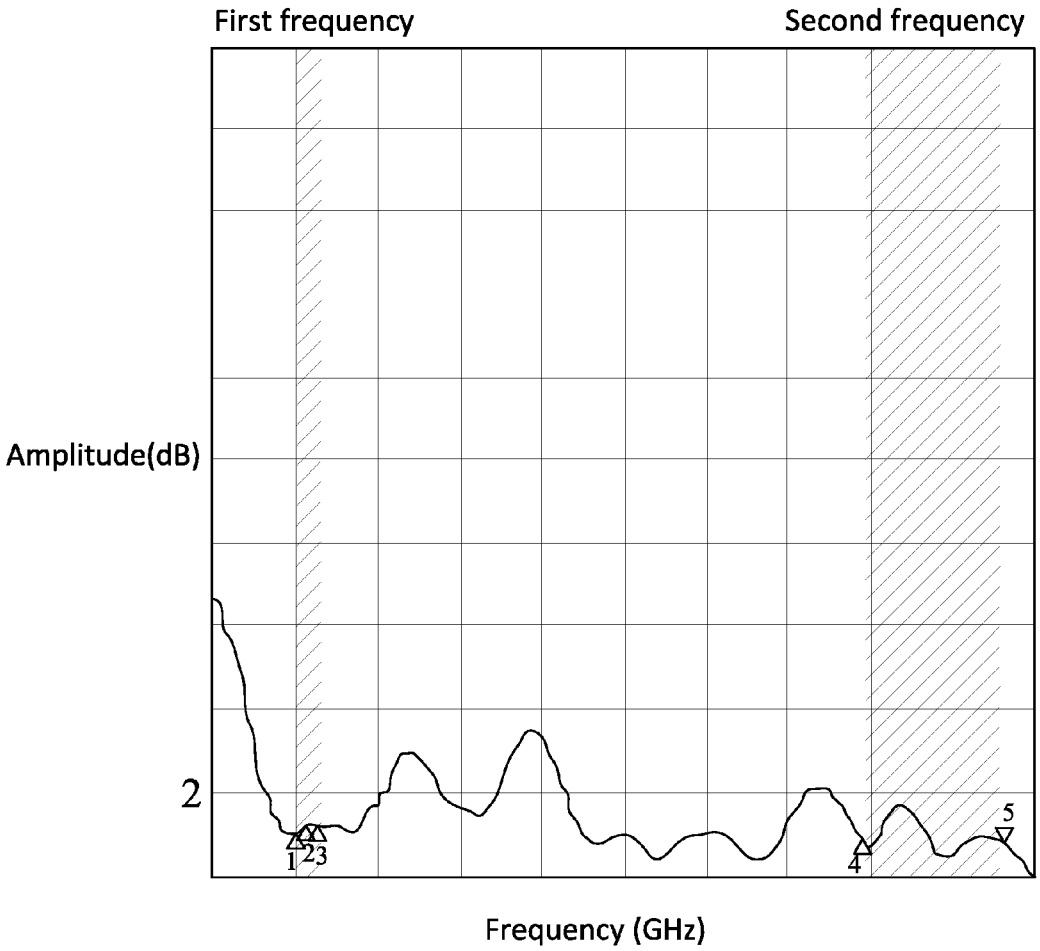
FIG. 2 is the second schematic view of the first embodiment in accordance with the present invention.

Please refer to FIG. 2, which is the second schematic view of the first embodiment of the dual-bank dipole antenna in accordance with the present invention. As shown in FIG. 2, the dual-band dipole antenna 1 can be used to serve as the antenna of a wireless communication device operated under the first frequency band (low operating frequency band), WiFi 802.11b/g/n (2.4~2.5 GHz), and under the second frequency band (high operating frequency band), WiFi 802.11a (5.15 GHz~5.85 GHz). FIG. 2 shows the dual-band dipole antenna 1 of the embodiment can exactly achieve great performance.

In addition, after being adjusted by the above method, the dual-band dipole antenna 1 can be applied to the wireless communication devices operated under other operating frequency band; for example, LTE-Band 7_2500~2690 MHz, LTE-Band 40_2300~2400 MHz or LTE-Band 38_2570~2620 MHz.

It is noteworthy to point out that the structure of most conventional antennas is complicated, which will significantly increase their manufacturing cost. On the contrary, the structure of the dual-band dipole antenna according to the present invention is very simple and can be implemented by a printed antenna; therefore, the manufacturing process of the dual-band dipole antenna does not need molds and assembly process, so its manufacturing cost can be dramatically reduced and its product competitiveness can be significantly increased.

Furthermore, due to the special design, the dual-band antenna in accordance with the present invention can still have great impedance matching even if the antenna is very close to the ground; thus, the dual-band antenna in accordance with the present invention can exactly achieve great performance.

Figure 3:
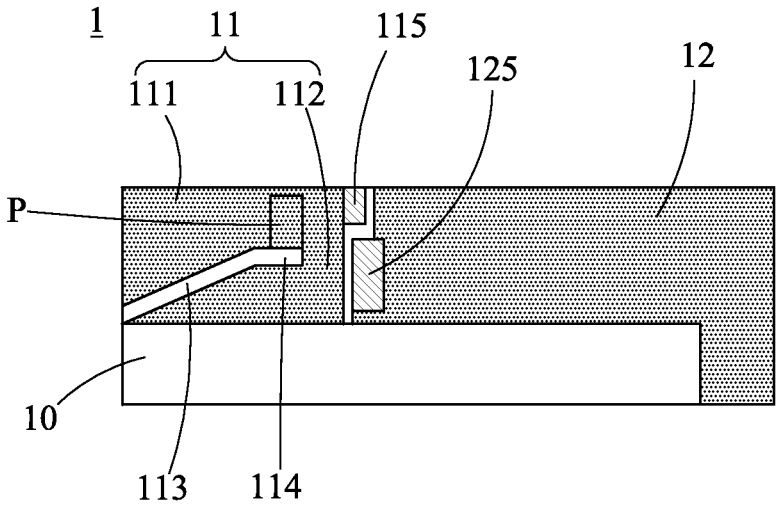
FIG. 3 is the first schematic view of the second embodiment in accordance with the present invention.
Figure 4:
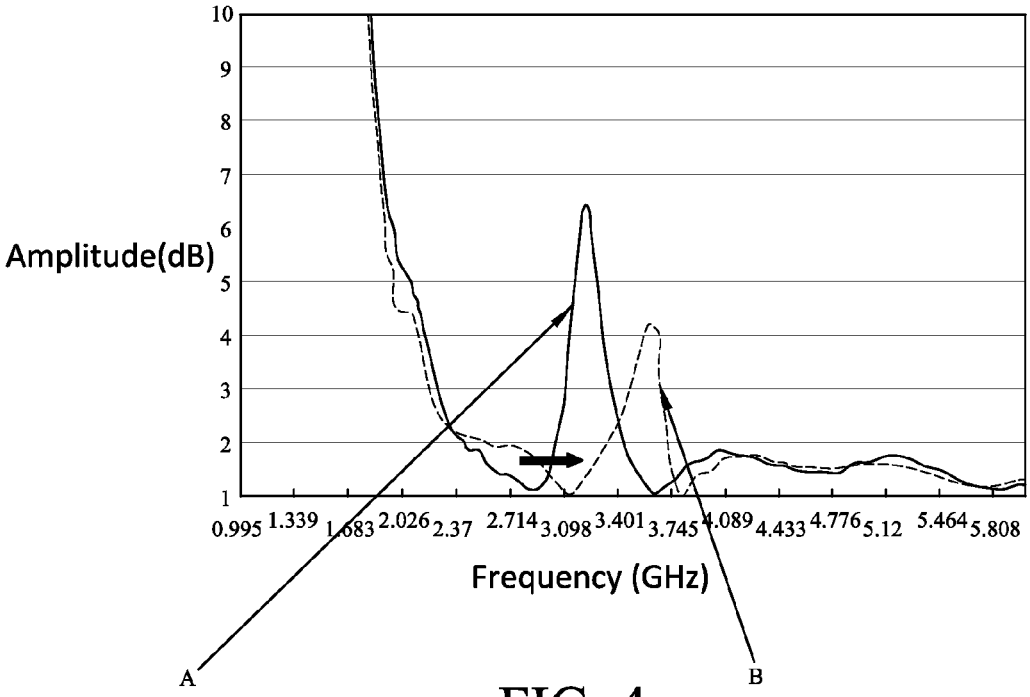
FIG. 4 is the second schematic view of the second embodiment in accordance with the present invention.

Please refer to FIG. 3 and FIG. 4, which are the first schematic view and the second schematic view of the second embodiment of the dual-bank dipole antenna in accordance with the present invention. As shown in FIG. 3, in the embodiment, a patch block P is used to fill the upper half of the slot 114 of the main radiator 11 to adjust the overall operating frequency band of the dual-band dipole antenna 1. The current path of the main radiator 11 can be changed if the upper half of the slot 114 of the main radiator 11 is filled by the patch block P, so the overall operating frequency band of the dual-band dipole antenna 1 can be changed. As shown in FIG. 4, "A" stands for the operating frequency band before the adjustment; "B" stands for the operating frequency band after the adjustment.

Figure 5:
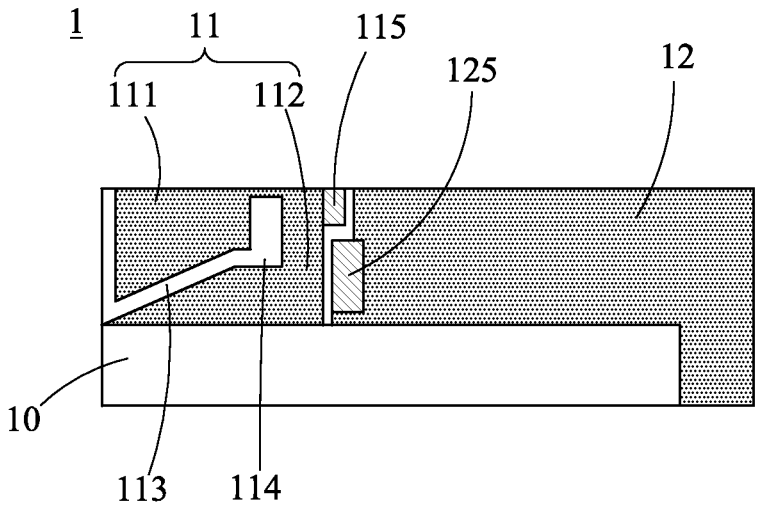
FIG. 5 is the first schematic view of the third embodiment in accordance with the present invention.
Figure 6:
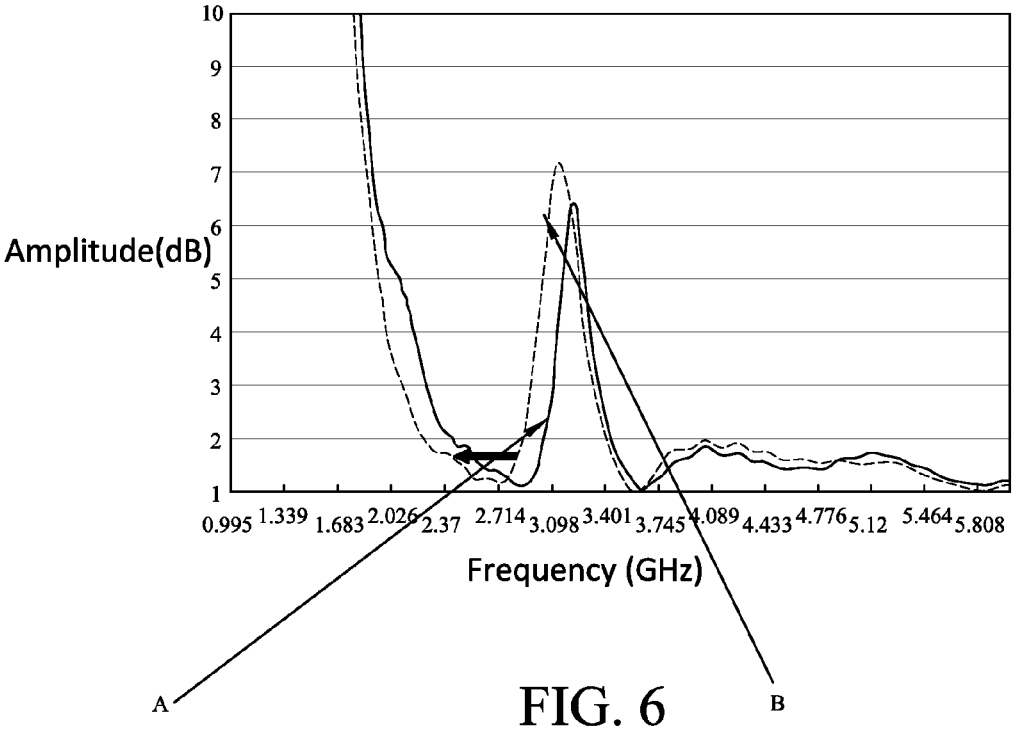
FIG. 6 is the second schematic view of the third embodiment in accordance with the present invention.

Please refer to FIG. 5 and FIG. 6, which are the first schematic view and the second schematic view of the third embodiment of the dual-bank dipole antenna in accordance with the present invention. As shown in FIG. 5, in the embodiment, the length of the first radiator 111 is modified to adjust the low operating frequency band of the dual-band dipole antenna 1. The current path of the first radiator 111 can be changed by removing a part of the first radiator 111 to change its length, so the low operating frequency band of the dual-band dipole antenna 1 can be adjusted.

As shown in FIG. 6, "A" stands for the operating frequency band before the adjustment; "B" stands for the operating frequency band after the adjustment; the low operating frequency band of the dual-band dipole antenna 1 is obviously moved toward the low frequency direction.

Figure 7:
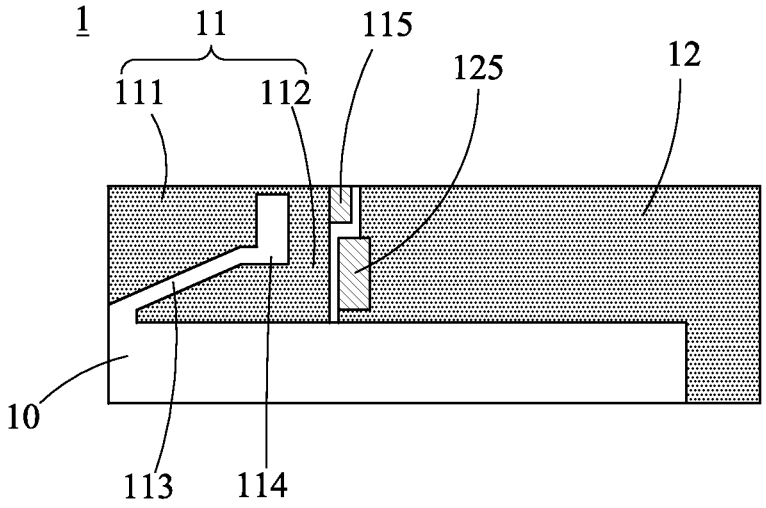
FIG. 7 is the first schematic view of the fourth embodiment in accordance with the present invention.
Figure 8:
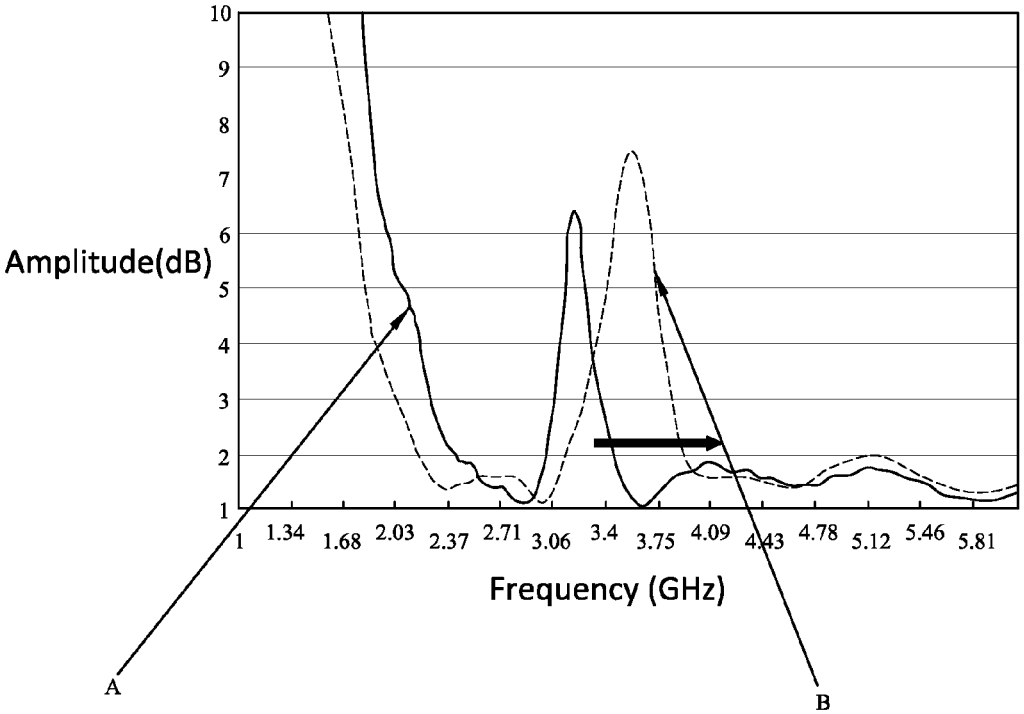
FIG. 8 is the second schematic view of the fourth embodiment in accordance with the present invention.

Please refer to FIG. 7 and FIG. 8, which are the first schematic view and the second schematic view of the fourth embodiment of the dual-bank dipole antenna in accordance with the present invention. As shown in FIG. 7, in the embodiment, the length of the second radiator 112 is modified to adjust the high operating frequency band of the dual-band dipole antenna 1. The current path of the second radiator 112 can be changed by removing a part of the second radiator 112 to change its length, so the high operating frequency band of the dual-band dipole antenna 1 can be adjusted.

As shown in FIG. 8, "A" stands for the operating frequency band before the adjustment; "B" stands for the operating frequency band after the adjustment; the high operating frequency band of the dual-band dipole antenna 1 is obviously moved toward the high frequency direction.

Figure 9:
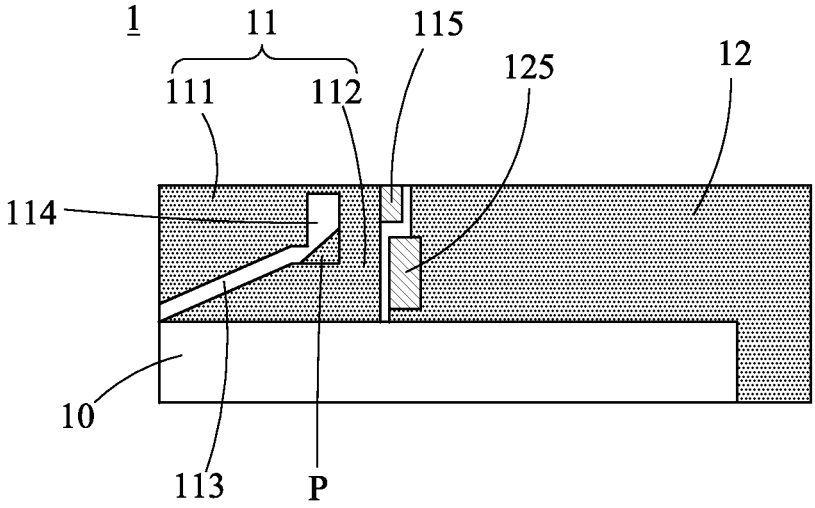
FIG. 9 is the first schematic view of the fifth embodiment in accordance with the present invention.
Figure 10:
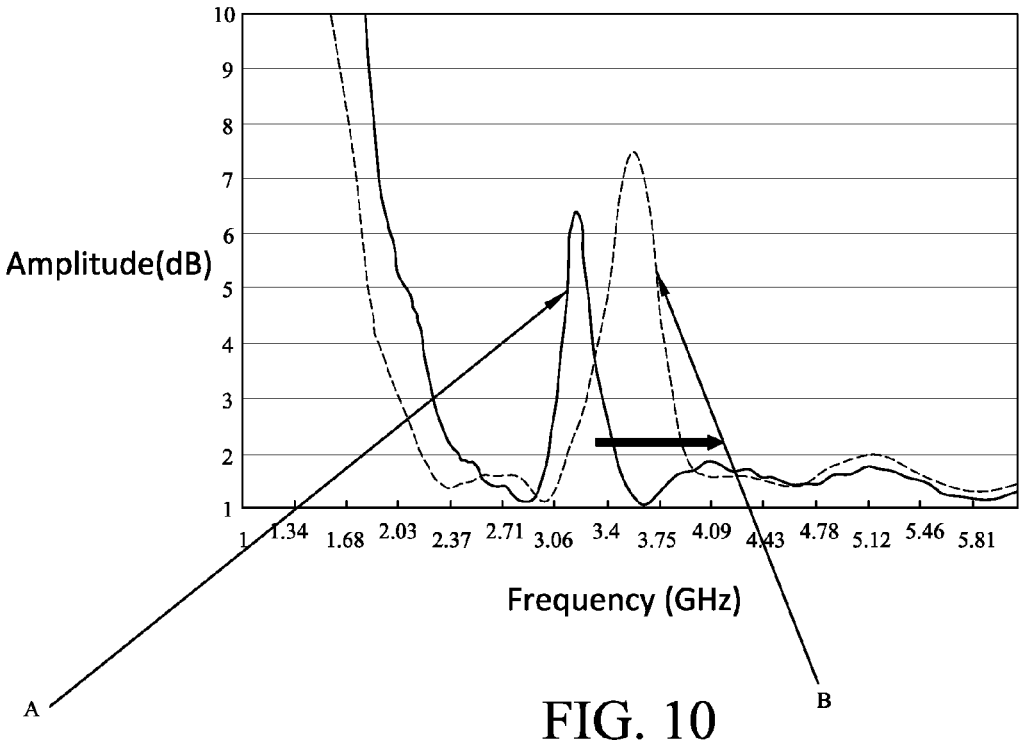
FIG. 10 is the second schematic view of the fifth embodiment in accordance with the present invention.

Please refer to FIG. 9 and FIG. 10, which are the first schematic view and the second schematic view of the fifth embodiment of the dual-bank dipole antenna in accordance with the present invention. As shown in FIG. 9, in the embodiment, a patch block P is used to fill the lower half of the slot 114 of the main radiator 11 to adjust the high operating frequency band of the dual-band dipole antenna 1. The current path of the main radiator 11 can be changed if the lower half of the slot 114 of the main radiator 11 is filled by the patch block P, so the high operating frequency band of the dual-band dipole antenna 1 can be changed.

As shown in FIG. 10, "A" stands for the operating frequency band before the adjustment; "B" stands for the operating frequency band after the adjustment; the high operating frequency band of the dual-band dipole antenna 1 is obviously moved toward the high frequency direction.

As described above, the antenna designer can not only adjust the overall operating frequency band of the dual-band dipole antenna in accordance with the present invention, but also can independently adjust its low operating frequency band or high operating frequency band; thus, the dual-band dipole antenna 1 can be easily designed to satisfy the requirements of various applications and can achieve great performance. Therefore, the present invention actually has an inventive step.

To sum up, in one embodiment of the present invention, the overall operating frequency of the dual-bank dipole antenna can be adjusted by adding one or more patch blocks to the main radiator to increase the size of the main radiator, such that the antenna can conform to various requirements and can be more flexible in usage.

Also, in one embodiment of the present invention, the low operating frequency band and the high operating frequency band can be fine-tuned by modifying the lengths of the first radiator and the second radiator, so the application of the antenna can be more comprehensive and be able to meet different requirements.

Besides, in one embodiment of the present invention, the design of the present invention can be implemented by a printed antenna, so the antenna can be manufacturing without using molds and without assembly process; accordingly, the cost of the antenna can be significantly reduced to increase its product competitiveness.

Moreover, the antenna according to the present invention can still have good impedance matching even if the antenna is very close to the ground, so the antenna can achieve better performance.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A dual-band dipole antenna, comprising:

a substrate;

a grounding area, being disposed on the substrate;

a main radiator, being disposed on the substrate and in the vicinity of the grounding area, wherein the main radiator comprises a first radiator and a second radiator; the first radiator is connected to the second radiator, and there is a groove between the first radiator and the second radiator; a size of the main radiator is not equal to a size of the grounding area;

a grounding point, being disposed on the substrate and connected to the grounding area; and a feed-in point, being disposed on the substrate and connected to the main radiator, wherein the feed-in point is in the vicinity of the grounding point, and one end of the groove is a sealed end in the vicinity of the feed-in point, and the other end of the groove is an opening; the groove extends from the sealed end to the opening in a direction away from the feed-in point; the first radiator extends from the feed-in point to form a gradually-widened structure, and the second radiator extends from the feed-in point to form a gradually-narrowed structure.

2. The dual-band dipole antenna of claim 1, wherein the grounding area is L-shaped and comprises a patch block.

3. The dual-band dipole antenna of claim 2, wherein the grounding area comprises two ends corresponding to each other in a first direction; one end is in the vicinity of the main radiator and disposed with the grounding point, and the other end is disposed with the patch block and the patch block extends in a second direction to make the grounding area be L-shaped.

4. The dual-band dipole antenna of claim 2, wherein the size of the grounding area is larger than the size of the main radiator.

5. The dual-band dipole antenna of claim 2, wherein the size of the grounding area is related to an impedance matching of the dual-band antenna.

6. The dual-band dipole antenna of claim 3, wherein the groove extends in a third direction away from the feed-in point to form the opening.

7. The dual-band dipole antenna of claim 6, wherein an included angle between the third direction and the first direction is an obtuse angle.

8. The dual-band dipole antenna of claim 1, wherein an operating frequency band of the second radiator is higher than an operating frequency band of the first radiator.

9. The dual-band dipole antenna of claim 1, wherein a length of the first radiator is related to a low operating frequency band of the dual-band dipole antenna.

10. The dual-band dipole antenna of claim 1, wherein a length of the second radiator is related to a high operating frequency band of the dual-band dipole antenna.

11. The dual-band dipole antenna of claim 1, wherein the grounding point and the feed-in point are disposed between the main radiator and the grounding area.

12. The dual-band dipole antenna of claim 1, the groove extends from a corner of the main radiator into an interior of the main radiator.

13. The dual-band dipole antenna of claim 12, the groove is connected to a slot inside the main radiator.

14. The dual-band dipole antenna of claim 12, a size of the slot is related to an overall operating frequency band of the dual-band dipole antenna.

* * * * *